US009644509B2

(12) United States Patent
Huang

(10) Patent No.: US 9,644,509 B2
(45) Date of Patent: May 9, 2017

(54) MUFFLER

(71) Applicant: Ford Global Technologies, LLC, Dearborn, MI (US)

(72) Inventor: Robben Huang, Nanjing (CN)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 15/001,820

(22) Filed: Jan. 20, 2016

(65) Prior Publication Data

US 2016/0230627 A1 Aug. 11, 2016

(30) Foreign Application Priority Data

Feb. 5, 2015 (CN) ..... 2015 1 0059899

(51) Int. Cl.
*F01N 1/02* (2006.01)
*F01N 1/08* (2006.01)

(52) U.S. Cl.
CPC ..... *F01N 1/089* (2013.01); *F01N 1/023* (2013.01); *F01N 1/083* (2013.01); *F01N 2470/18* (2013.01); *F01N 2470/20* (2013.01); *F01N 2490/06* (2013.01)

(58) Field of Classification Search
CPC ..... F01N 1/089; F01N 1/086; F01N 1/02
USPC ..... 181/268
See application file for complete search history.

(56) References Cited

U.S. PATENT DOCUMENTS

| | | | | |
|---|---|---|---|---|
| 3,113,635 | A * | 12/1963 | Allen | F01N 1/06 181/252 |
| 3,434,565 | A | 3/1969 | Fischer | |
| 4,501,341 | A | 2/1985 | Jones | |
| 4,911,262 | A * | 3/1990 | Tani | F01N 1/02 181/266 |
| 6,644,437 | B1 * | 11/2003 | Hayman | F01N 1/02 181/237 |
| 6,959,782 | B2 * | 11/2005 | Brower | F01N 1/02 181/238 |
| 7,032,709 | B2 * | 4/2006 | Hoche | F01N 1/02 181/268 |
| 7,117,973 | B2 * | 10/2006 | Graefenstein | F01N 1/06 181/253 |
| 7,380,635 | B2 * | 6/2008 | Harris | F01N 1/06 181/206 |

(Continued)

FOREIGN PATENT DOCUMENTS

| | | | |
|---|---|---|---|
| CN | 201125766 | Y | 10/2008 |
| EP | 1510668 | A1 | 3/2005 |
| GB | 1394605 | A | 5/1972 |

*Primary Examiner* — Forrest M Phillips
(74) *Attorney, Agent, or Firm* — Greg Brown; McCoy Russell LLP

(57) ABSTRACT

The present invention in one or more embodiments provides a muffler, where the muffler includes a housing extending along a longitudinal direction, and a resonator device supported on the housing and including a body, the body including a first portion and a second portion spaced apart from and to be in fluid communication with the first portion, the fluid communication being positioned in a direction transverse to the longitudinal direction, at least one of the first portion and second portion being of a closed-loop in cross-section. The muffler of the present invention may effectively enhance reduction of low frequency noise without having to necessarily increase package volume.

20 Claims, 3 Drawing Sheets

(56) References Cited

U.S. PATENT DOCUMENTS

| | | | | |
|---|---|---|---|---|
| 7,503,427 | B2 * | 3/2009 | Toyoshima | F01N 1/003 181/249 |
| 7,571,789 | B2 * | 8/2009 | Gilli | F01N 1/24 181/239 |
| 2004/0245044 | A1 * | 12/2004 | Cerrato-Jay | F01N 1/02 181/268 |
| 2007/0045044 | A1 * | 3/2007 | Sullivan | F01N 1/02 181/268 |
| 2007/0102236 | A1 | 5/2007 | Uhlemann et al. | |
| 2011/0024228 | A1 | 2/2011 | Murakami et al. | |

* cited by examiner

MUFFLER

CROSS-REFERENCE TO RELATED APPLICATION

This application claims the benefit of Chinese Patent Application No. 201510059899.9, filed Feb. 5, 2015, the entire contents of which are hereby incorporated by reference for all purposes.

TECHNICAL FIELD

The present invention relates to a muffler.

BACKGROUND/SUMMARY

Mufflers are widely used in exhaust systems of internal engines to reduce the noises often due to exhaust gases exiting the engines. For instance, publication US2011/0024228A1 discloses a pre-muffler with inner and outer cylinder cavities in an effort to provide an added amount of noise reduction.

In one or more embodiments, the present invention provides a muffler, where the muffler includes a housing extending along a longitudinal direction, and a resonator device supported on the housing and including a body, the body including a first portion and a second portion spaced apart from and to be in fluid communication with the first portion, the fluid communication being positioned in a direction transverse to the longitudinal direction, at least one of the first and second portion being of a closed-loop in cross-section.

One or more advantageous features as described herein are believed to be readily apparent from the following detailed description of one or more embodiments when taken in connection with the accompanying drawings.

BRIEF DESCRITION OF THE DRAWINGS

Figure 1A:
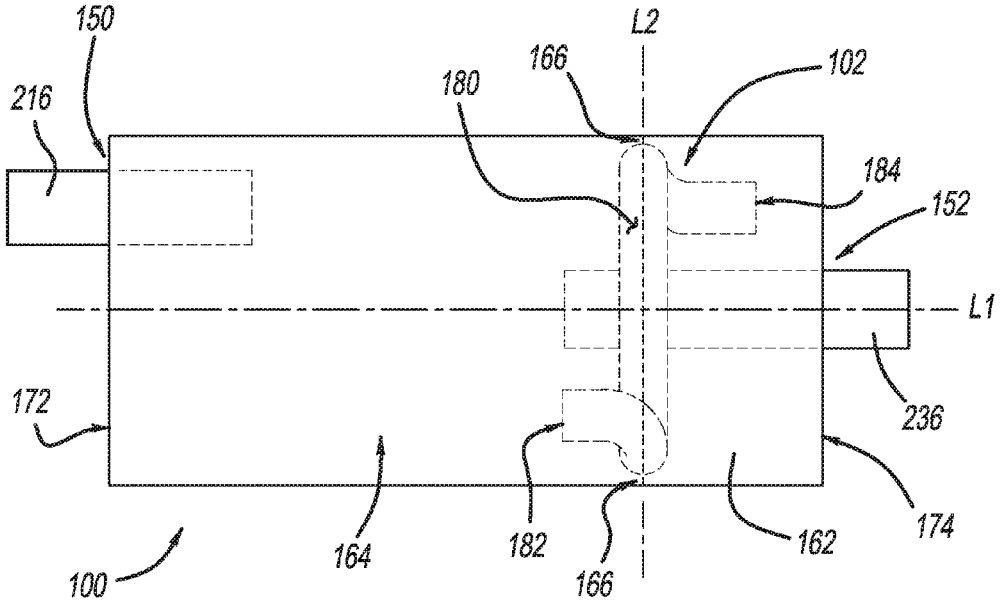
Figure 1B:
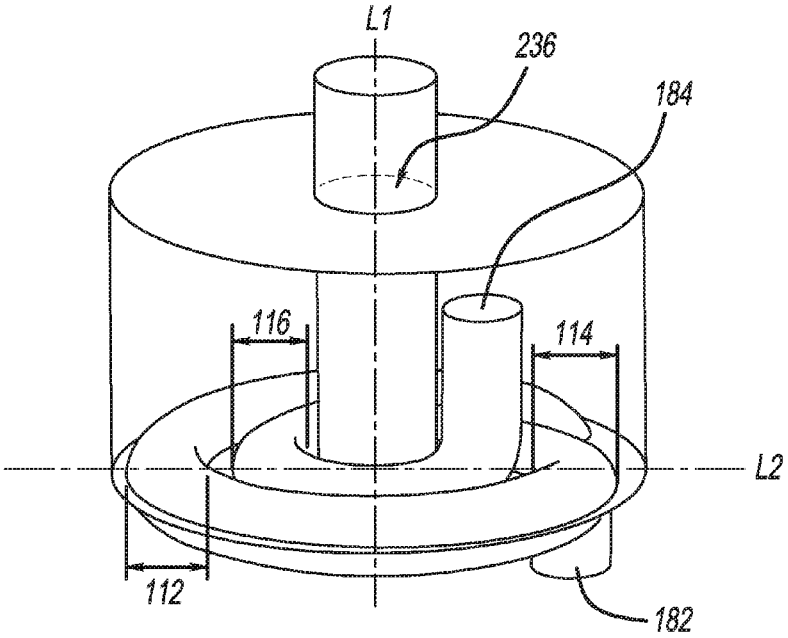
Figure 2:
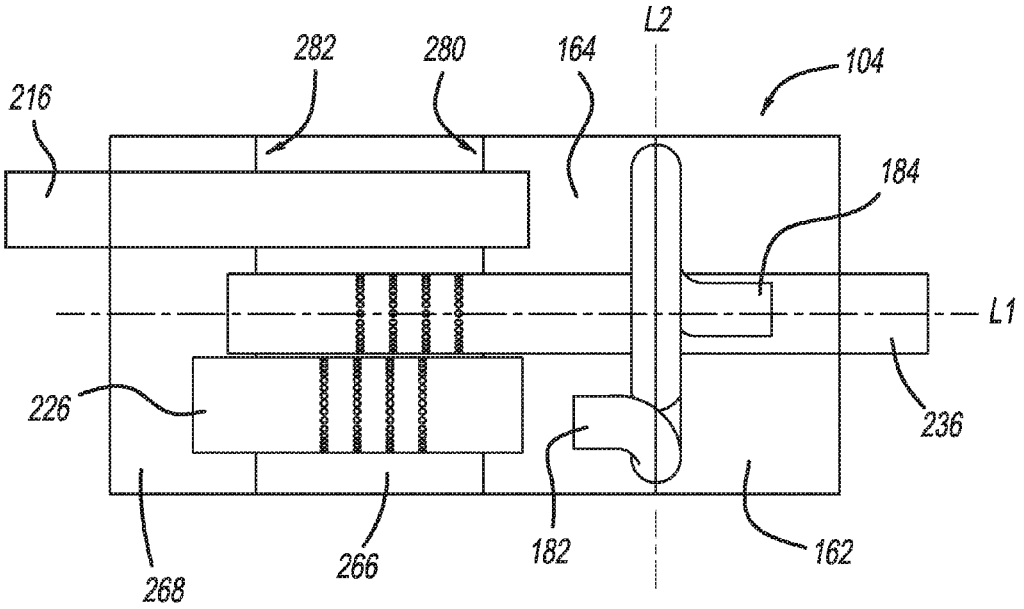
Figure 3:
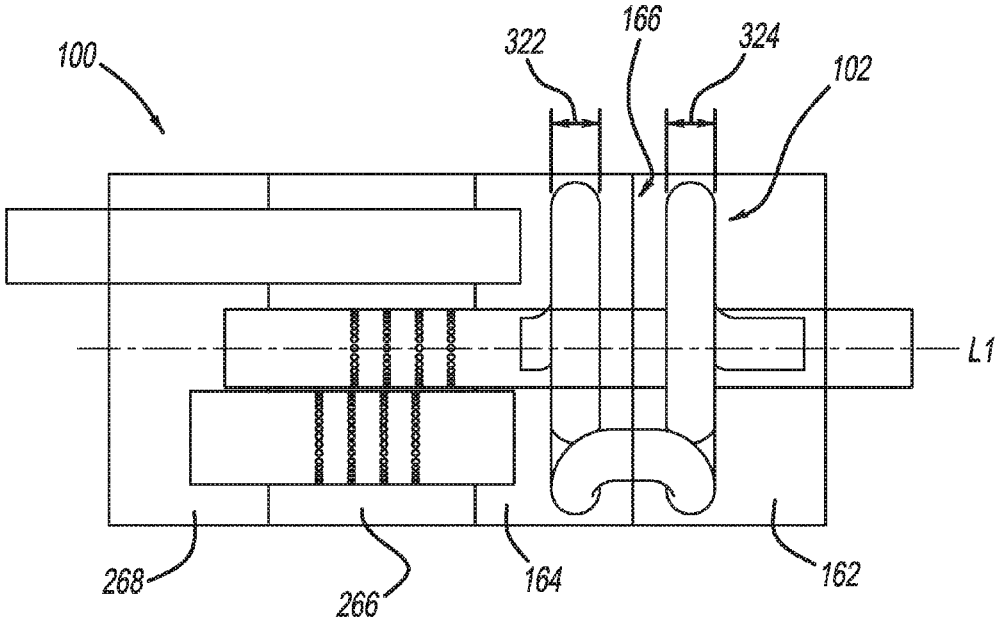
Figure 4:
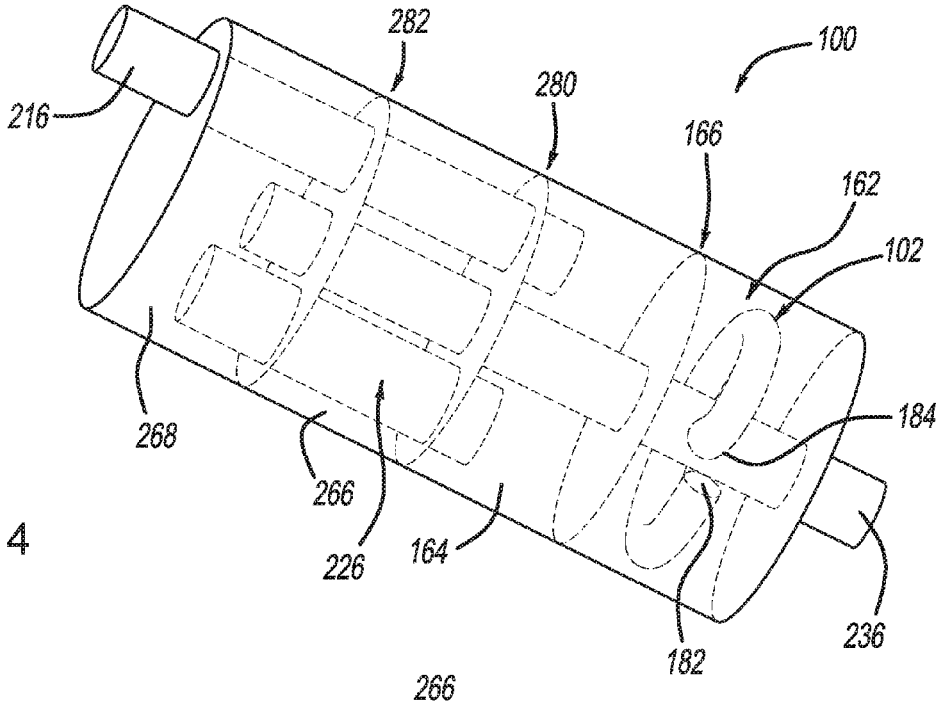
Figure 5:
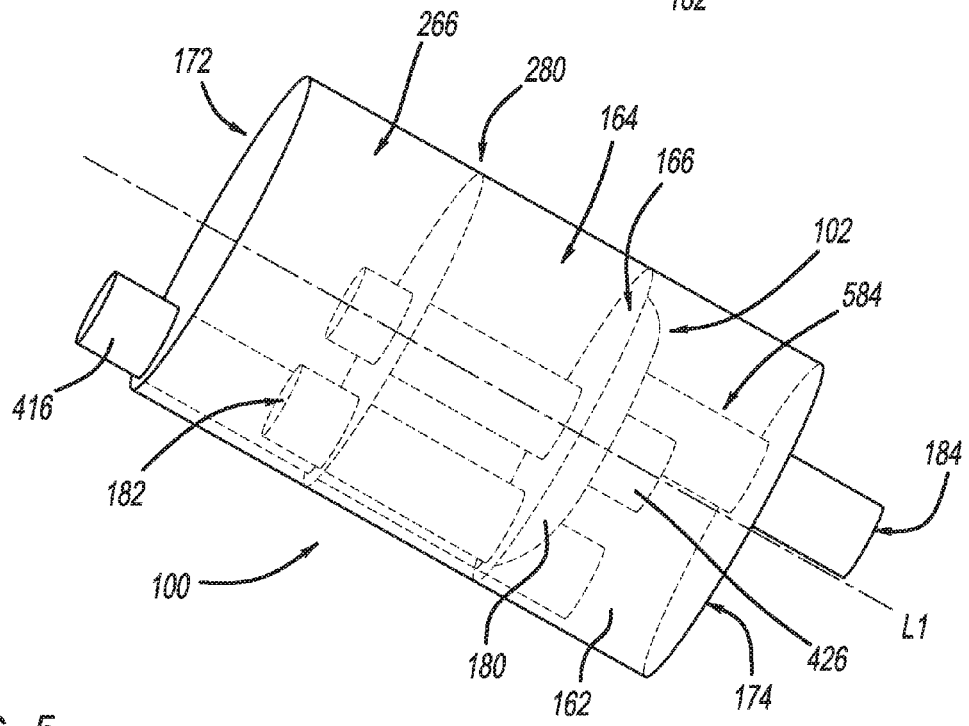

FIG. 1A illustratively depicts a view of a muffler according to one or more embodiments of the present invention;

FIG. 1B illustratively depicts another view of the muffler referenced in FIG. 1A;

FIG. 2 illustratively depicts an alternative embodiment of the muffler referenced in FIG. 1A;

FIG. 3 illustratively depicts another alternative embodiment of the muffler referenced in FIG. 1A;

FIG. 4 illustratively depicts yet another alternative embodiment of the muffler referenced in FIG. 1A; and FIG. 5 illustratively depicts yet another alternative embodiment of the muffler referenced in FIG. 1A.

DETAILED DESCRIPTION

One or more embodiments of the present invention are described herein with details; however, it is appreciated that much of the detailed description is provided as illustrative examples and may be varied as suitable. The drawings referenced herein are schematic and associated views thereof are not necessarily drawn to scale, where certain features may be enlarged or minimized to show details. Particular structures and functional details as referenced in the detailed description are not meant to be limiting and rather form the representative basis upon which variations may be realized in carrying out the present invention.

The present invention in one or more embodiments reflects an enhanced awareness in relation to low frequency noises. In particular, in order to damp noises in certain specific frequency ranges such as noises in low frequency ranges, a Helmholtz resonator may be advantageously configured to deliver a relatively more desirable reduction of the low frequency noises. The awareness is at least in part based on the resonance frequency (f) of a Helmholtz resonator, of which an equation may be stated as follows:

$$f = \frac{c}{2\pi}\sqrt{\frac{S_c}{Vl_c}}$$

Where c represents speed of light, $S_c$ represents a cross-sectional area, V represents the volume of a resonator chamber, and $l_c$ represents the length of a resonator pipe. It may be obtained from the equation that resonance frequency may be lowered by increasing the volume of the resonator chamber or increasing the length of the resonator pipe.

Certain existing Helmholtz resonators may be suitable for four-cylinder engines. However, with increasingly more stringent requirement in fuel economy and carbon dioxide ($CO_2$) emission, three-cylinder engines become relatively more desirable. With a given engine output volume, the three-cylinder engines may be with larger volume per cylinder and hence greater pulse energy. In addition, to move to employing the three-cylinder engine from the four-cylinder engine, it may be difficult to increase the volume of the resonator chamber or the length of the resonator pipe due to a limited underbody package space. A general Helmholtz resonator may not meet the requirement of low frequency noises, and therefore issues in low frequency noises may arise. As is detailed herein elsewhere, the present invention in one or more embodiments is believed to be advantageously at least in providing a muffler with relatively enhanced reduction capacity for low frequency tuning and hence potentiating the employment of the three-cylinder engine without having to compromise on noise control.

The present invention in one or more embodiments is advantageous in providing a muffler to be relatively more effective in reducing low frequency noises, where the muffler includes a housing extending in a longitudinal direction, and a resonator device with a body, the body of the resonator device including a first portion and a second portion spaced apart from and to be in fluid communication with the first portion, the fluid communication being positioned in a direction transverse to the longitudinal direction, at least one of the first and second portions being of a closed-loop in cross-section. The muffler of the present invention may be provided with a substantial increase in the length of the resonator device without necessarily have to increase the volume of muffler.

FIGS. 1A-5 show example configurations with relative positioning of the various components. L1 is longitudinal direction, L2 is a transverse direction transverse to the longitudinal direction L1. The present description is related to a muffler. In one non-limiting example, the muffler may be configured as illustrated in FIG. 1A. FIG. 1B illustrates another view of the muffler reference d in FIG. 1A. FIGS. 2-5 illustrate other alternative views of the muffler referenced in FIG. 1A. The muffler 100 includes a housing 104 and a resonator device 102 supported on the housing 104. In one or more embodiments, the shape of the housing 104 and the resonator device 102 may be varied as needed. The housing 104 may include apertures to receive and support the inlet and outlet pipes on its anterior and posterior ends, respectively. Multiple partition walls may separate the housing 104 into different chambers along the longitudinal direction L1. The muffler 100 may be configured with any suitable number of chambers as needed. The partition walls may include apertures to receive and support the inlet pipe, outlet pipe, intermediate pipe, and the inlet neck of the resonator. For example, the second partition wall 280 in FIG. 2 may define one or more apertures to receive and support the pipes 216, 226 and 236. As yet another example, the second partition wall 280 in FIG. 5 may define apertures to receive and support pipes 416, 426, and inlet neck 182 of resonator 102. A portion of the intermediate pipe and outlet pipe may have a plurality of perforations, for example, the intermediate pipe 226 and outlet pipe 236 in FIG. 2. The perforations may be arranged in a single ring, or include a plurality of rings, as indicated in the figures. Portions of the pipes may be free of perforations as well, as indicated in the figures.

FIG. 1A illustratively depicts a view of a muffler 100 according to one or more embodiments of the present invention. The muffler 100 includes a housing 104 and a resonator device 102 supported on the housing 104. The housing 104 may be an elongated cylinder or a hollow cylinder, extending along a longitudinal direction L1. In certain embodiments, an exhaust pipe in whole or in parts such as pipes 216 and 236 referenced in FIG. 1A extends along the longitudinal direction L1. For instance also, the housing 104 may include an aperture 150 to receive and support the pipe 216. In certain other embodiments, the housing 104 may be of a suitable shape, and in one example of a shape corresponding to an underbody of a vehicle in which the muffler is mounted.

The housing 104 may include along the longitudinal direction L1 an anterior end 172, a posterior end 174 opposing the anterior end 172 and a first partition wall 166 between the anterior and posterior ends 172, 174, where the anterior end 172 and the posterior end 174 at least partially enclose the housing 104. The first partition wall 166 separates the housing 104 into a first chamber 162 and a second chamber 164 along the longitudinal direction L1. In certain embodiments, the first chamber 162 may be referred to as a resonator chamber, and the second chamber 164 may be referred to as an expansion chamber, the resonator device 102 and the first chamber or the resonator chamber 162 together define a Helmholtz resonator, for instance, a side-branch resonator.

As mentioned herein elsewhere, the muffler 100 may further work together with two or more pipes which are to transport exhaust gases into and out of the housing 104, for instance, the pipe 216 as an inlet pipe and being supported on the anterior end 172 to introduce exhaust gases into the second chamber 164, the pipe 236 as an outlet pipe and being supported on the first partition wall 166 and the posterior end 174 to release exhaust gases out of the housing 104 from the second chamber 164, where the first partition wall 166 defines an aperture 152 to receive and support the outlet pipe 236. The inlet pipe 216 is to be in fluid communication with the outlet pipe 236 within the second chamber 164.

Further in view of FIG. 1A and FIG. 1B, and in one or more embodiments, the resonator device 102 is configured as a tubular structure, while in other embodiments, the shape of the resonator device 102 may be varied as needed. The resonator device 102 may include a body 180 and an inlet neck 182 and an outlet neck 184 extending from the body 180 in opposite directions. In one or more embodiments, the inlet neck 182 is positioned within the second chamber 164, and the outlet neck 184 is positioned within the first chamber 162. The body 180 of the resonator device 102 may be positioned closer to the posterior end 174 than the anterior end 172. In certain other embodiments, the body 180 of the resonator 102 may be positioned closer to the anterior end 172 than the posterior end 174 (not shown).

Further in view of FIG. 1B, the body 180 includes a first portion 112 and a second portion 114 spaced apart from and to be in fluid communication with the first portion 112, the fluid communication being positioned in a transverse direction L2 transverse to the longitudinal direction L1. The transverse direction L2 is a direction not parallel to the longitudinal direction L1. In certain embodiments, the transverse direction L2 is of an angle, relative to the longitudinal direction L1, for example, 45 to 90 degrees. At least one of the first portion 112 and the second portion 114 is of a closed-loop in cross-section such that at least one of the first portion 112 and the second portion 114 provides relatively more directed fluid flow. As illustratively depicted in FIG. 1B, the first portion 112 and the second portion 114 are positioned at opposite sides of the outlet pipe 236, or that the outlet pipe 236 is positioned between the first portion 112 and the second portion 114 of the resonator device 102.

In certain embodiments, and where the housing 104 is configured as a circular cylinder, the longitudinal direction L1 may also be the longitudinal axis L1.

Referring back to FIG. 1B, the first portion 112 and the second portion 114 may each be of a closed-loop in cross-section. Further, the body 180 may include a third portion 116 spaced apart from the first portion 112 and being opposite to the second portion 114 relative to the longitudinal direction L1 or the outlet pipe 236. That is, the body 180 of the resonator device 102 wraps in at least one round around the longitudinal direction L1 or the outlet pipe 236. By doing so, it may substantially increase the length of the resonator device 102 within a given volume of space. Accordingly, reduction of low frequency noises may be favorably improved per the Helmholtz equation.

FIG. 2 illustratively depicts an alternative view of the muffler referenced in FIG. 1A. The same reference numerals are used to refer to the same components. Although the muffler 100 referenced in FIG. 1A includes two chambers, for instance, the first chamber 162 and the second chamber 164, more chambers may be defined in the muffler 100. In one or more embodiments, the muffler 100 referenced in FIG. 2 may include along the longitudinal direction L1 the first partition wall 166, a second partition wall 280 and a third partition wall 282 as positioned within the housing 104. The first partition wall 166 defines and separates the first chamber 162 and the second chamber 164. The second partition wall 280 defines a third chamber 266, where the second chamber 164 is positioned between the first chamber 162 and the third chamber 266 along the longitudinal direction L1. The third partition wall 282 defines a fourth chamber 268, where the third chamber 266 is positioned between the second chamber 164 and the fourth chamber 268 along the longitudinal direction L1. In another one or more embodiments, the muffler 100 may be configured with any suitable number of chambers as needed.

In addition to the pipes 216 and 236 referenced in FIG. 1A, the muffler 100 referenced in FIG. 2 further includes an intermediate pipe 226 positioned within the housing 104 and supported by the second partition wall 280 and the third partition wall 282. In one or more embodiments, at least one of the first, second and third partition walls 166, 280, and 282 may include apertures to receive and support one or more pipes. Referring back to FIG. 2, the first, second and third partition walls 166, 280, and 282 may each define one or more apertures to receive and support the pipes 216, 236 and 226. In operation, an exhaust flow enters the second chamber 164 from the inlet pipe 216, and then enters the fourth chamber 268 via the intermediate pipe 226, and then is released out of the body 104 of the muffler 100 via the outlet pipe 236.

FIG. 3 illustratively depicts another alternative view of the muffler referenced in FIG. 1A. The body 180 of the resonator device 102 referenced in FIG. 3 may include a fourth portion 322 and a fifth portion 324 spaced apart from each other along the longitudinal direction L1. The fourth portion 322 and fifth portion 324 are positioned respectively at two opposing sides of the first partition wall 166, and positioned within the second chamber 164 and the first chamber 162 of the housing 104 of the muffler 100, respectively. Further in view of FIG. 1B, portions 112, 114 and/or 116 may be or include a part of the fifth portion 324; conversely, the fourth portion 322 may be or include a part of the portions of 112, 114 and/or 116.

FIG. 4 illustratively depicts yet another alternative view of the muffler referenced in FIG. 1A. The resonator device 102 of the muffler 100 referenced in FIG. 4 is positioned within the first chamber (resonator chamber) 162 with one end 182 thereof being connected to the outlet pipe 263 and another end 184 thereof being connected to the first chamber 162. In this design, the exhaust flow enters the second chamber 164 via the pipe 216, is expanded within the second chamber 164, then returns to the fourth chamber 268 via the pipe 226, is further expanded within the fourth chamber 268, and is released out of the housing 104 via the pipe 236, where noise reduction of certain low frequency ranges is realized with the resonator device 102 in its arrangement with the pipe 236.

While the longitudinal direction L1 referenced in FIGS. 1A-4 is illustratively depicted as a centerline for the housing 104, and the resonator device 102 surrounds the outlet pipe 236 substantially concentrically, the longitudinal direction L1 and/or the outlet pipe 236 may be positioned at any suitable places of the housing 104 along the transverse direction, that is the resonator device 102 may not have to wrap around the outlet pipe 236 or may not have to wrap around the outlet pipe 236 concentrically.

FIG. 5 illustratively depicts yet another alternative view of the muffler 100 in one or more embodiments of the present invention or as yet another alternative to the design referenced in FIG. 1A. The muffler 100 may include the housing 104 and the resonator device 102 supported on the housing 104. The housing 104 may include along the longitudinal direction L1 the anterior end 172, the posterior end 174 opposing the anterior end 172, and the first partition wall 166 and the second partition wall 280 positioned within the housing 104 between the anterior and posterior ends 172, 174 along the longitudinal direction L1, where the anterior end 172 and the posterior end 174 at least in part enclose the housing 104. The first partition wall 166 separates the housing 104 into the first chamber 162 and the second chamber 164 along the longitudinal direction L1. The second partition wall 280 defines the third chamber 266. The first chamber 162 and the second chamber 164 work alone or in combination as an expansion chamber, and the third chamber 266 may function as a resonator chamber, where the resonator device 102 and the third chamber (resonator chamber) 266 may together be configured as a Helmholtz resonator, for instance, an in-line resonator. The muffler 100 may further include more pipes to transport exhaust gases into and out of the housing 104, for instance, an inlet pipe 416 supported on the anterior end 172 and the first partition wall 166 to introduce exhaust gases into the first chamber 162, an outlet pipe 584 supported on the first partition wall 166 and the posterior end 174 to transport exhaust gases out of the housing 104 from the second chamber 164, and an intermediate pipe 426 supported on the first partition wall 166 and the second partition wall 280. The first partition wall 166 and the second partition wall 280 may each define apertures to receive and support pipe 416, 426 and 584. The outlet pipe 584 may also be a part of the resonator device 102 and include an outlet neck 184. In operation, the exhaust flow enters into the first chamber 162 from the inlet pipe 416, enters into the third chamber 266 from the first chamber 162 via the intermediate pipe 426, and then is released out of the housing 104 of the muffler 100 via the outlet pipe 584.

While the body 180 of the resonator device 102 in one or more embodiments as referenced in FIGS. 1A-4 is illustratively depicted as a tubular structure with a circular or near circular cross-section, the shape of the body 180 may be varied as needed in certain other embodiments. As illustratively depicted in FIG. 5, the resonator device 102 may include the body 180 and an inlet neck 182 and an outlet neck 184 respectively extending from the two ends of the body 180 in opposite directions, where the body 180 may have a semi-circular or near semi-circular cross-section. The inlet neck 182 may be positioned in the third chamber 266, and the outlet neck 184 may be positioned external to the housing 104. The body 180 of the resonator device 102 may be positioned closer to the posterior end 174 than the anterior end 172. The body 180 may contact and be supported on the first partition wall 166. The body 180 and the first partition wall 166 together define a closed pipe via, for instance but not limited to, soldering the body 180 onto the first partition wall 166. Accordingly the cross-section of the body 180 may be defined by two cross-sectional ends along the longitudinal direction L1, where one of the two cross-sectional ends may be a part of the first partition wall 162. By doing so, the length of the resonator device 102 may be substantially increased within a given amount of space which is often limited.

The Figures show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

One or more embodiments described herein are illustrative and exemplary, and are not limiting. One skilled in the art may readily recognize various changes, modifications and variations that may be made herein without departing from the true spirit and fair scope of the present invention as defined by the following claims.

The invention claimed is:

1. A muffler comprising:

a housing extending along a longitudinal direction;

a resonator device supported on the housing and including a body, the body including a first portion and a second portion spaced apart from and to be in fluid communication with the first portion, the fluid communication being positioned in a direction transverse to the longitudinal direction, at least one of the first and second portions being of a closed-loop in cross-section, wherein a neck of the resonator device including the first and second portions wraps around the longitudinal direction at least once, wherein the neck is inside the housing.

2. The muffler of claim 1, further comprising an aperture to receive an outlet pipe extending along the longitudinal direction and being positioned between the first and second portions of the resonator device, wherein the first portion and the second portion are radially spaced so as to be diametrically opposed.

3. The muffler of claim 1, wherein the resonator device further includes inlet and outlet necks extending from the body in opposite directions, the housing including a first partition wall defining and separating a first chamber and a second chamber.

4. The muffler of claim 2, wherein the body includes a third portion spaced apart from the first portion and being opposite to the second portion relative to the outlet pipe.

5. The muffler of claim 1, wherein the housing includes an anterior end and a posterior end along the longitudinal direction, the body of the resonator device being positioned closer to one of the anterior and posterior ends than the other.

6. The muffler of claim 1, wherein the body of the resonator device includes fourth and fifth portions spaced apart from each other along the longitudinal direction.

7. The muffler of claim 1, wherein the housing includes a first partition wall defining and separating a first chamber and a second chamber, the resonator device contacting the first partition wall, the muffler further comprising an aperture to receive an outlet pipe extending along the longitudinal direction, wherein the resonator neck is positioned within the first chamber with one end thereof being connected to the outlet pipe and another end thereof being connected to the first chamber.

8. The muffler of claim 7, wherein a cross-section of the body of the resonator device along the longitudinal direction is defined by two cross-section ends, one of which being a part of the first partition wall.

9. The muffler of claim 7, wherein the body of the resonator device contacts the first partition wall.

10. The muffler of claim 7, further comprising a second partition wall defining a third chamber, the second chamber being positioned between the first and third chambers along the longitudinal direction.

11. The muffler of claim 10, further comprising a third partition wall defining a fourth chamber, the third chamber being positioned between the second and fourth chambers along the longitudinal direction.

12. The muffler of claim 11, wherein at least one of the first, second and third partition walls includes an aperture to receive and support a portion of a number of pipes.

13. The muffler of claim 1, further comprising an outlet pipe, wherein the resonator device contacts the outlet pipe.

14. A vehicle system, comprising:

a muffler coupled in an engine exhaust system, the muffler including a housing extending along a longitudinal direction of a vehicle, a resonator device supported on the housing and including a body, a neck of the body including a first portion and a second portion spaced apart from and in fluid communication with the first portion, the first and second neck portions both forming a wrap fully around the longitudinal direction and inside the housing, the fluid communication being positioned in a direction transverse to the longitudinal direction and around an exhaust pipe having an outlet exiting the muffler, each of the first and second neck portions being closed-loop in cross-section.

15. The system of claim 14, wherein the muffler further comprises an aperture to receive the outlet pipe extending along the longitudinal direction and being positioned between the first and second neck portions of the resonator device, wherein the outlet pipe includes a ring of perforations.

16. The system of claim 15, wherein the resonator device further includes inlet and outlet necks extending from the body in opposite directions.

17. The system of claim 16, wherein the body includes a third portion spaced apart from the first portion and being opposite to the second portion relative to the outlet pipe.

18. The system of claim 17, wherein the housing includes an anterior end and a posterior end along the longitudinal direction, the body of the resonator device being positioned closer to one of the anterior and posterior ends than the other.

19. The system of claim 18, wherein the body of the resonator device includes fourth and fifth portions spaced apart from each other along the longitudinal direction.

20. The system of claim 19, wherein the housing includes a first partition wall defining and separating a first chamber and a second chamber, the resonator device contacting the first partition wall, wherein a cross-section of the body of the resonator device along the longitudinal direction is defined by two cross-section ends, one of which being a part of the first partition wall, wherein the body of the resonator device contacts the first partition wall.

* * * * *